US011391274B2

(12) United States Patent
Reinhard

(10) Patent No.: US 11,391,274 B2
(45) Date of Patent: Jul. 19, 2022

(54) FLUID MOVEMENT DEVICE

(71) Applicant: ProMinent GmbH, Heidelberg (DE)

(72) Inventor: Martin Reinhard, Heidelberg (DE)

(73) Assignee: ProMinent GmbH, Heidelberg (DE)

( * ) Notice: Subject to any disclaimer, the term of this patent is extended or adjusted under 35 U.S.C. 154(b) by 52 days.

(21) Appl. No.: 16/499,433

(22) PCT Filed: Jun. 14, 2018

(86) PCT No.: PCT/EP2018/065784
§ 371 (c)(1),
(2) Date: Sep. 30, 2019

(87) PCT Pub. No.: WO2018/234145
PCT Pub. Date: Dec. 27, 2018

(65) Prior Publication Data

US 2020/0200162 A1 Jun. 25, 2020

(30) Foreign Application Priority Data

Jun. 21, 2017 (DE) ..... 10 2017 113 724.6

(51) Int. Cl.
*F04B 43/073* (2006.01)
*F04B 53/10* (2006.01)
(Continued)

(52) U.S. Cl.
CPC ..... *F04B 43/02* (2013.01); *F04B 43/023* (2013.01); *F04B 43/04* (2013.01); *F04B 53/1002* (2013.01)

(58) Field of Classification Search
CPC ..... F04B 43/02; F04B 43/04; F04B 53/1002; F04B 17/04; F04B 19/006; F04B 43/0054; F04B 43/043
(Continued)

(56) References Cited

U.S. PATENT DOCUMENTS 4,776,771 A * 10/1988 Kern ..... F04B 43/0027 417/307
4,786,240 A 11/1988 Koroly et al.
(Continued)

FOREIGN PATENT DOCUMENTS

CN 101438057 A 5/2009
CN 201582069 U 9/2010
(Continued)

OTHER PUBLICATIONS

Nora Lindner, The International Bureau of the World Intellectual Property Organization, International Preliminary Report on Patentability, PCT/EP2018/065784, dated Jan. 2, 2020 (English translation).

(Continued)

*Primary Examiner* — Dominick L Plakkoottam
(74) *Attorney, Agent, or Firm* — Paul & Paul

(57) ABSTRACT

A device for moving a fluid includes a dosing head in which a dosing chamber is arranged, and a displacement element which can be moved between a first and second position. The displacement element borders the dosing chamber, and the volume of the dosing chamber in the first position differs from the volume in the second position. drive unit for moving the displacement element from the first position to the second position and a return mechanism for moving the displacement element back are provided. The return mechanism has two magnetic parts. The first part is placed on the dosing head, the second part is connected to the displacement element, and the two parts are designed such that a magnetic force causes a force to be applied to the displacement element in the direction of the first position.

10 Claims, 3 Drawing Sheets

(51) Int. Cl.
*F04B 43/02* (2006.01)
*F04B 43/04* (2006.01)

(58) Field of Classification Search
USPC ..... 417/413.1, 395
See application file for complete search history.

(56) References Cited

U.S. PATENT DOCUMENTS 5,011,380 A * 4/1991 Kovacs ..... A61M 60/40 417/413.1
6,334,761 B1 * 1/2002 Tai ..... F16K 99/0046 417/413.3
2004/0191093 A1 * 9/2004 Weigl ..... F04B 43/04 417/413.1
2006/0013710 A1 1/2006 Lee
2009/0148320 A1 6/2009 Lucas
2011/0274566 A1 * 11/2011 Amirouche ..... F04B 43/043 417/322
2011/0286868 A1 11/2011 Sardet
2013/0315757 A1 * 11/2013 Tsuboi ..... F04B 43/043 417/413.1
2014/0030116 A1 * 1/2014 Wallace ..... F04B 15/00 417/53
2016/0051740 A1 2/2016 Wegener et al.
2018/0171995 A1 * 6/2018 Minoia ..... F04B 43/067

FOREIGN PATENT DOCUMENTS

CN 102312810 A 1/2012
DE 102014010108 B4 1/2016

OTHER PUBLICATIONS

China National Intellectual Property Administration, First Office Action, dated Mar. 1, 2021, Chinese Application No. 201880041424.9.
China National Intellectual Property Administration, Second Office Action, dated Aug. 4, 2021, Chinese Application No. 201880041424.9.

* cited by examiner

FLUID MOVEMENT DEVICE

CROSS-REFERENCE TO RELATED APPLICATION

This application is a 371 national stage application of International Application PCT/EP2018/065784, filed Jun. 14, 2018, and claims the priority of German Application No. 10 2017 113 724.6, filed on Jun. 21, 2017.

The present invention relates to a device for moving a fluid, having a metering head in which a metering chamber is disposed, and a displacement element which can be moved back and forth between a first and a second position, wherein the displacement element delimits the metering chamber, and the volume of the metering chamber in the first position of the displacement element differs from the volume of the metering chamber in the second position, wherein a drive unit is provided for moving the displacement element out of the first position into the second position and a return mechanism is provided for moving the displacement element out of the second position into the first position.

Devices of this type are known and are used as metering pumps, for example. They are often used to meter chemicals. In particular, these include points of use such as the treatment of drinking water with disinfectants, metering of corrosion inhibitors and biocides in cooling circuits, metering flocculating agents in waste water treatment, metering additives in the paper industry and metering additives in the manufacture of synthetic materials.

The metering chamber of a pump of this type comprises a fluid outlet through which fluid located in the metering chamber can be forced out. This occurs because of the change in volume in the metering chamber caused by the displacement element which is controlled by the drive unit. Fluid is forced out due to a reduction of the volume in the metering chamber. As a rule, the metering chamber will additionally have a fluid inlet through which fluid can be sucked into the metering chamber. A fluid can be conveyed by means of the alternating change in volume of the metering chamber, wherein in the case of an increase in the volume, fluid will be sucked into the metering chamber via the fluid inlet, and in the event of a reduction in the volume, fluid will be forced out of the metering chamber via the fluid outlet.

In order to prevent fluid from accidentally being able to flow back, appropriately disposed one way valves are used.

Alternatively, the fluid movement device described may also be used as a pulsator. Pulsators can drive extraction columns, for example.

In contrast to the metering pump, the pulsator does not have a fluid inlet (or the fluid inlet is closed). Here again, the volume of the metering chamber is cyclically increased and reduced, so that the pressure of the fluid also varies cyclically. In this regard—in contrast to a pump—there is no transport of fluid from a fluid inlet to a fluid outlet. Instead of this, a cyclically varying pressure is produced in a working line connected to the fluid outlet.

The drive unit for moving the displacement element of a device of this type may be a hydraulic drive unit. A device of this type is known from DE 10 2014 010 108 B4, for example. The displacement element therein is configured as a membrane delimiting the metering chamber from a hydraulic chamber. If the pressure of the hydraulic fluid in the hydraulic chamber is increased, then it moves the displacement element from a first position into a second position, and a recovery of the displacement element from the second position into the first position is additionally supported by a hydraulically produced negative pressure. Furthermore, it is also usual to bring about the recovery by means of a spring force. When using a spring force to recover the displacement element, the displacement element must include a guide for the spring.

While the recovery of a displacement element supported by means of a hydraulically produced negative pressure means that a large amount of effort has to be expended to produce the continuous negative pressure and the negative pressure production is limited because hydraulic oil could outgas, recovery by means of spring force takes up a large amount of space in order to be able to accommodate the construction elements necessary for the recovery. A consequence of the requirement for a large amount of space is a higher cost for the displacement element and its guide.

Therefore, one aim of the present invention is to provide a device which overcomes the disadvantages mentioned above. In particular, one aim of the present invention is to provide a device which is compact in design and which operates reliably.

At least one of these objectives is achieved by means of a device of the type defined above, in which the return mechanism comprises two parts, wherein each part is either a magnet or an element produced from a ferromagnetic material, wherein the first part is disposed on the metering head, the second part is connected to the displacement element, and the two parts are configured in a manner such that a magnetic force acting between the two parts exerts a force on the displacement element in the direction of the first position.

The fundamental concept of the invention is the magnetic operation of the return mechanism. Thus, in addition, at least one of the two parts must be configured as a permanent magnet or as an electromagnet.

By employing magnets or parts produced from ferromagnetic materials in the return mechanism, no additional guide is necessary for the displacement element.

In this respect, elements may be applied to or in front of the parts of the return mechanism which have an attenuating action when these parts impact against each other and/or may be used as a spacer between the parts of the return mechanism.

In one embodiment of the present invention, the two parts of the return mechanism are configured and arranged in a manner such that a repulsive magnetic force is exerted between them.

In order to produce the repulsive magnetic force, the two parts have to be magnetized or magnetizable in a manner such that identical magnetic poles are facing each other. Each part may thus comprise either a permanent magnet or an electromagnet.

The first part of the return mechanism may be firmly attached to the metering head at a position such that the second part of the return mechanism, which, is connected to the displacement element, is repelled from the first part and thus brings about a movement of the displacement element in the direction of the first position.

The magnetic restoring force is therefore greater the closer the displacement element gets to the second position.

As an example, the material for the permanent magnet may be an alloy formed from neodymium, iron and boron. Permanent magnets of this type may be in the form of disks and have a minimum repulsive force of approximately 150 N with a stroke of 1 mm.

In a further embodiment of the present invention, the two parts of the return mechanism are configured and arranged in a manner such that an attractive magnetic force is exerted between them.

In order to produce an attractive magnetic force, the two parts must be disposed in a manner such that different magnetic poles are facing each other. This may, for example, be carried out by means of two appropriately disposed permanent or electromagnets. As an alternative, however, one of the two parts of the return mechanism may consist of a ferromagnetic element, so that it is magnetized and attracted by the other part. In this case, the magnetic restoring force is higher the closer the displacement element gets to the first position.

In a further preferred embodiment, a recess is disposed in a wall of the metering chamber, in which the part of the return mechanism which is disposed on the metering head is positioned, wherein preferably, the part of the return mechanism which is disposed on the displacement element is also at least partially positioned in the recess.

As an example, the metering chamber may comprise a recess the dimensions of which correspond to the size of the first part, so that the first part sits flush in the recess. As an alternative, the recess may be configured in a manner such that the second part of the return mechanism which is disposed on the displacement element is at least partially positioned in the recess.

The recess may additionally serve as a guide for the second part of the return mechanism.

When the two parts of the return mechanism are configured in a manner such that a repulsive force acts between them, the first part does not have to be attached to the metering head, because the repulsive force of the second part forces it into the recess.

In a further preferred embodiment of the present invention, the return mechanism comprises a third part which is a magnet or an element formed from a ferromagnetic material, wherein the third part is connected to the metering head and the three parts of the return mechanism are configured and arranged in a manner such that an attractive magnetic force acts between the third part and the second part of the return mechanism.

In this case, the first and the third parts of the return mechanism are disposed on opposite sides of the displacement element so that the first part exerts a repulsive force on the second part, and therefore on the displacement element, and the third part exerts an attractive force on the second part, and therefore on the displacement element. This embodiment in particular has the advantage that the strong dependency of the magnitude of the magnetic force on the separation between the attractive or repulsive poles is substantially reduced, because when the displacement element moves, in fact one of the two forces, i.e. either the attractive force between the third and the second parts or the repulsive force between the first and the second parts, is greatly reduced, but at the same time the other of the two forces becomes stronger.

In a further embodiment of the present invention, the drive unit is a hydraulic drive unit.

The hydraulic drive unit may, for example, comprise a displacement piston which executes an alternating movement and in this manner, periodically pressurizes hydraulic fluid. The hydraulic fluid then transmits a periodically acting force to the displacement element, whereupon the displacement element also executes a periodic movement in the direction of the actuating force. In this manner, the volume of the metering chamber increases and reduces. By means of the return mechanism in accordance with the invention, a reduction in pressure in the hydraulic system brings about a rapid recovery movement of the displacement element into the first position.

In a further embodiment of the invention, the displacement element is a membrane.

As an example, a short stroke membrane may be used as the displacement element. Short stroke membranes are characterized by the fact that the distance between the first and the second positions is much smaller, frequently at least 95% smaller than the nominal diameter. In this regard, the nominal diameter is the largest diameter of the mobile part of the membrane. Short stroke membranes are used in odorizing pumps, for example. They are frequently produced from metal. For odorizing pumps, the typical dimensionless ratio of nominal diameter to theoretical membrane deflection is 69.

Alternatively, a long stroke membrane may also be employed. Typical materials for use as a long stroke membrane are suitable synthetic materials such as PTFE or rubber, for example. In a further embodiment of the device in accordance with the invention, the magnet is a permanent magnet.

Depending on the field of application, various geometries such as, for example, disk magnets, ring magnets, conical magnets, rod magnets, cuboid magnets, dice magnets or spherical magnets may be envisaged.

In precisely those cases in which the displacement element has to execute a relatively large movement between the first and second positions, because of the large variation in the magnitude of the magnetic force during the movement of the displacement element associated with it, it is possible to employ the embodiment with a three-part return mechanism. As an example, three structurally identical disk magnets may be employed, wherein a first magnet (as the first part) is fastened to a surface of the metering chamber, a second magnet (as the second part) is firmly attached to a membrane as the displacement element and a third magnet (as the third part) is inserted into a hydraulic block.

In this case, the second magnet could also be integrated into the membrane; in this case in particular, when the membrane consists of several layers, it is a simple matter to dispose the magnet between the individual layers.

In a further embodiment of the device in accordance with the invention, the volume of the metering chamber is smaller in the second position than in the first position.

In a further embodiment of the device in accordance with the invention, the metering head comprises a head cover in which the metering chamber is disposed, a fluid outlet via which fluid from the metering chamber can leave the metering head, and a drive unit block, wherein preferably, the first part is disposed in the head cover.

Frequently, one way valves are disposed both at the fluid inlet and also at the fluid outlet.

Further advantages, features and application possibilities of the present invention will become apparent from the description of embodiments below and also of the associated figures.

FIG. 1 is a diagrammatic sectional view of a metering head 2 with a short stroke membrane 4.

Figure 1:
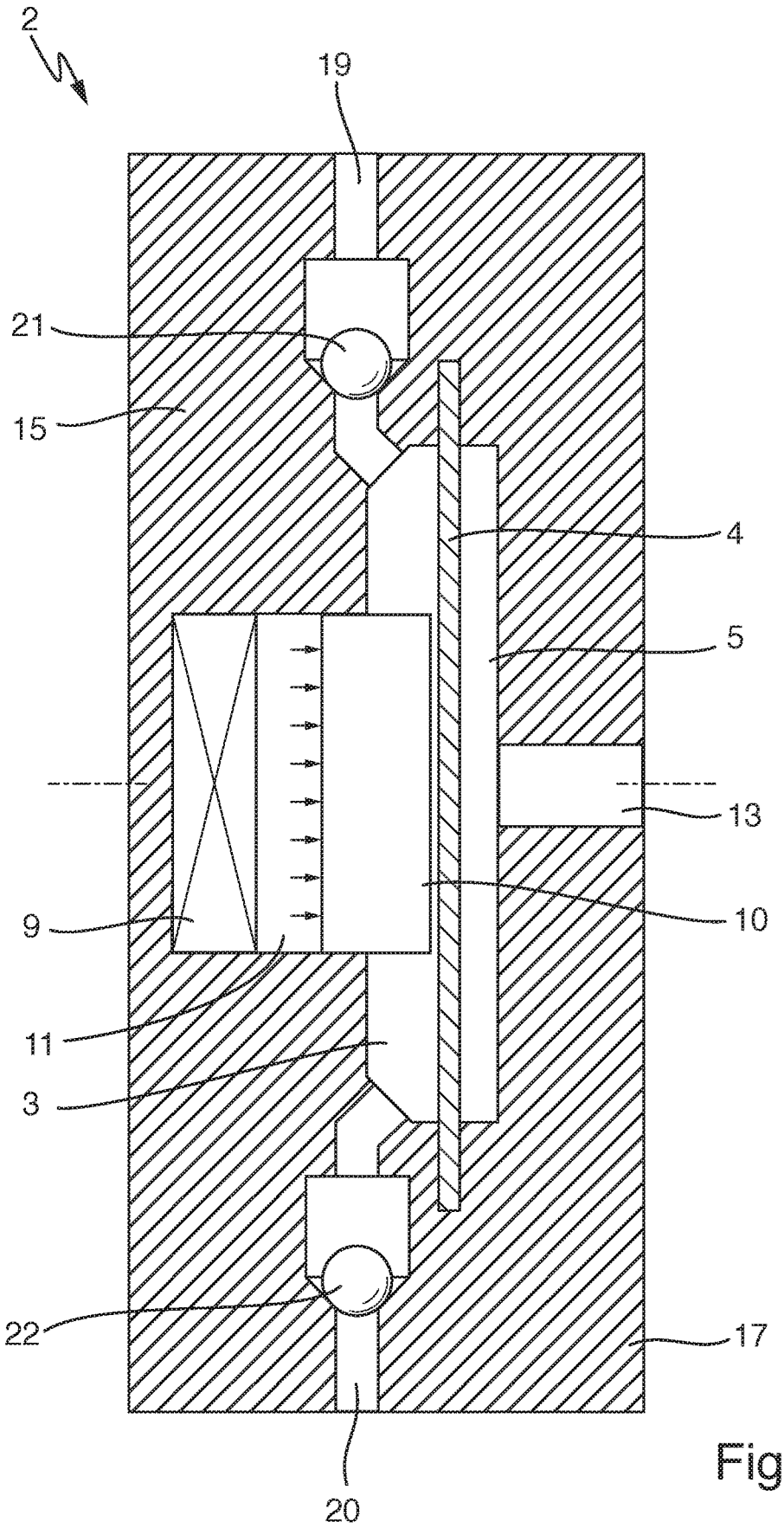
FIG. 1 shows a diagrammatic sectional view in accordance with an embodiment of the present invention with a short stroke membrane, in which the magnetic force of the return mechanism acts repulsively.

The metering head 2 is configured in two parts and consists of a head cover 15 and a drive unit block 17. A hydraulic channel 13 is disposed in the drive unit block 17 and is connected to a hydraulic drive unit (not shown). Furthermore, in the metering head 2 is a metering chamber 3, in which the displacement element configured as a membrane 4 is positioned. The membrane 4 is clamped between the head cover 15 and the drive unit block 17. The cavity disposed between the head cover 15 and drive unit block 17 is divided into a metering chamber 3 and a hydraulic chamber 5 by the membrane 4. An alternating pressure can be applied to the hydraulic chamber 5 by means of the hydraulic drive unit.

The metering chamber 3 is connected to a fluid outlet 19 via a pressure side one way valve 21 and to a fluid inlet 20 via a suction side one way valve 22.

If an alternating pressure is applied to the hydraulic chamber 5 by means of the hydraulic drive unit, this results in a back and forth movement of the membrane 4, with the consequence that the volume of the metering chamber 3 alternately increases and reduces. If the pressure in the hydraulic chamber 5 is raised, then the membrane 4 moves to the left in FIG. 1 and the volume in the metering chamber 3 is reduced, with the consequence that the pressure in the metering chamber 3 rises. As soon as the pressure in the metering chamber 3 is greater than a fluid pressure in a pressure line connected to the fluid outlet 19, the pressure side one way valve 21 opens and metered fluid is forced out of the metering chamber 3 via the fluid outlet 19.

When the pressure in the hydraulic chamber 5 is reduced, the pressure in the metering chamber 3 falls and the membrane 4 moves to the right in FIG. 1. The pressure side one way valve 21 then closes. As soon as the pressure in the metering chamber 3 is lower than the pressure in a suction line connected to the fluid inlet 20, the suction side one way valve 22 opens and metering fluid is sucked into the metering chamber 3 via the fluid inlet 20. This procedure is then repeated continuously.

The embodiment comprises a return mechanism which comprises a first part 9 and a second part 10. In the embodiment shown, both the first part 9 and also the second part 10 are configured as permanent magnets which are disposed in a manner such that identical poles are opposite to each other, so that the second part 10 is repelled from the first part 9.

The head cover 15 comprises a recess 11 in which the first part 9 is disposed. The second part 10 is connected to the membrane 4 and is also partially disposed in the recess 11. The recess 11 here also acts as a guide for the second part 10.

In fact, the pressure provided by the hydraulic drive unit is somewhat increased in this embodiment, because now an additional force has to be applied to the membrane 4 which acts against the repulsive magnetic force between the first part 9 and the second part 10, however the return movement of the membrane 4, i.e. when the membrane 4 is supposed to move towards the right, is accelerated by the magnetic force between the first and the second part 9, 10.

Figure 2:
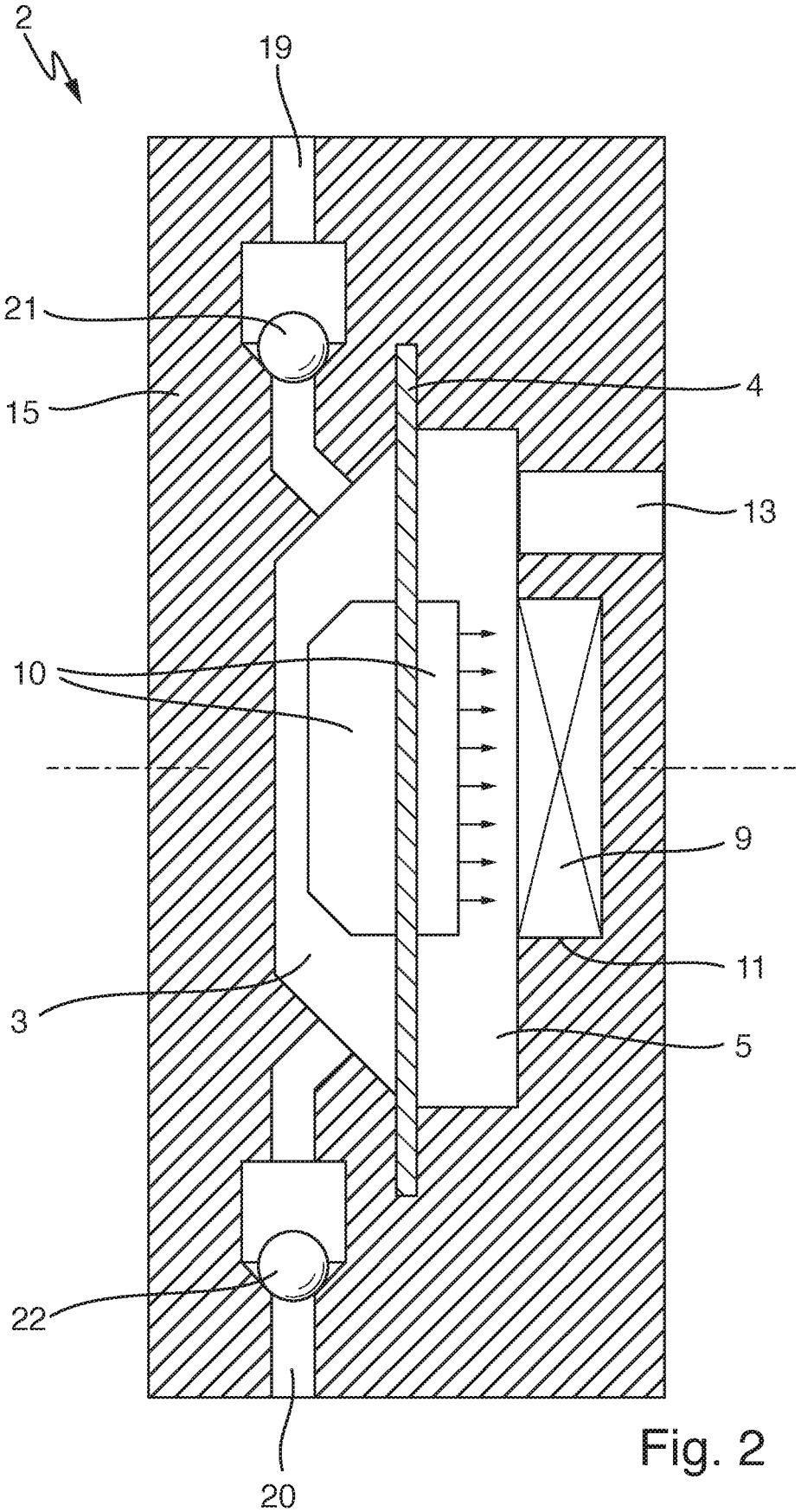
FIG. 2 shows a diagrammatic sectional view in accordance with an embodiment of the present invention with a short stroke membrane, in which the magnetic force of the return mechanism acts attractively.

FIG. 2 shows a diagrammatic sectional view of a second embodiment of the device in accordance with the invention. As far as possible, the same reference numerals as those used in FIG. 1 have been used.

In analogy with FIG. 1, FIG. 2 shows a metering head 2 which is configured in two parts and which consists of a head cover 15 and a drive unit block 17. The drive unit block 17 comprises an adjoining hydraulic channel 13 which is connected to a hydraulic drive unit (not shown). In addition, a metering chamber 3 is disposed in the metering head 2; the membrane 4 is located in the metering chamber and is clamped between the head cover 15 and the drive unit block 17. Adjacent to this membrane 4 and opposite to the cavity which is configured as the metering chamber 3 is a second cavity which corresponds to the hydraulic chamber 5. In addition to these elements, the head cover 2 additionally comprises a pressure side one way valve 21 which adjoins the metering chamber 3 and is in fluid communication therewith, which is connected to a fluid outlet 19 and a suction side one way valve 22 which is connected to a fluid inlet 20.

In contrast to the embodiment in FIG. 1, in this case the first part 9 is not disposed in the metering chamber 15, but in a recess 11 in the drive unit block 17.

In addition, the two parts which are configured as magnets in this case are disposed with different poles facing each other, so that the two parts 9, 10 attract. In this regard, the magnet for the second part 10 is integrated into the membrane 4.

The function essentially corresponds to the function of the embodiment shown in FIG. 1. However, in this case, in addition, the attractive force between the first and second parts 9, 10 must be overcome by the hydraulic drive unit. If the pressure in the hydraulic chamber 5 is reduced, then the attractive force between the first and the second parts will ensure a reliable and rapid return of the membrane 4 into the first (right hand) position.

Figure 3:
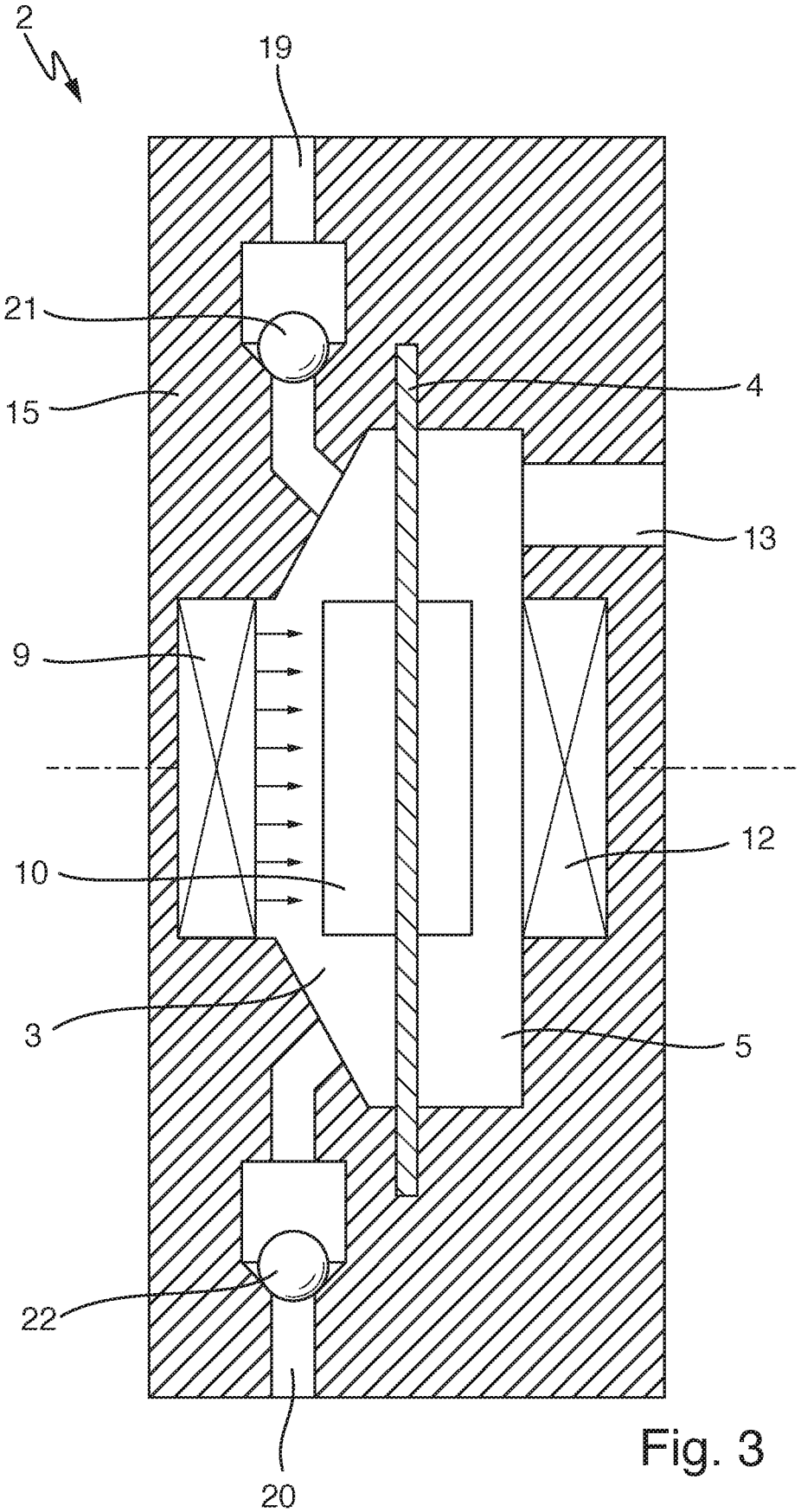
FIG. 3 shows a diagrammatic sectional view in accordance with an embodiment of the present invention with a long stroke membrane, in which the return mechanism is configured in three parts.

FIG. 3 shows a diagrammatic sectional view of a metering head 2 configured in two parts which consists of a head cover 15 and a drive unit block 17. The metering head 2 has a metering chamber 3 disposed in it, which is connected to a fluid outlet 19 via a pressure side one way valve 21 and to a fluid inlet 20 via a suction side one way valve 22. Adjoining the metering chamber, but interrupted by a membrane which is clamped between the drive unit block 17 and the head cover 15, is a hydraulic chamber 5, wherein the hydraulic chamber is connected to a hydraulic drive unit (not shown) via a hydraulic channel 13.

In this case, the membrane employed is a long stroke membrane 6 by means of which larger quantities of a fluid than in the case of a short stroke membrane can be conveyed, because the stroke, i.e. the distance between the first (right) position and the second (left) position of the membrane is greater. Because the magnetic force used in accordance with the invention is strongly dependent on the separation of the parts of the return mechanism, the embodiments shown in FIGS. 1 and 2 are of only limited use, because if the separation is too large, the desired additional magnetic force in accordance with the invention is only very weak.

Therefore, in the embodiment shown in FIG. 3, a return mechanism which is in three parts is envisaged, wherein the three parts are disposed in a manner such that the first part 9 of the return mechanism is supported in a recess 11 in the head part 15, the second part 10 of the return mechanism is connected to a membrane 6 and the third part 12 is connected to the drive unit block 17. In this example, the three parts of the return mechanism consist of three permanent magnets, preferably of three structurally identical disk magnets.

The magnets are configured and arranged in a manner such that between the first part 9 and the second part 10 of the return mechanism, a repulsive magnetic force prevails, and between the second part 10 and the third part 12, an attractive force prevails.

Basically, the third embodiment is a combination of the first and the second embodiments.

If the pressure in the hydraulic chamber 5 is increased by means of the hydraulic drive unit, then the membrane 6 is moved to the left against the attractive magnetic force between the second part 10 and the third part 12 and against the repulsive magnetic force between the first part 9 and the second part 10.

If the hydraulic drive unit does not exert any more force, then the superimposition of the repulsive magnetic force and the attractive magnetic force of the magnets brings about a return of the membrane from the second position into the first position.

With the aid of the superimposition of the magnetic forces, by using a third part of the return mechanism, a larger magnetic force is obtained, the consequence of this being that with this embodiment of the device in accordance with the invention, longer stroke lengths are possible, as are required in pumps in which long stroke membranes 6 are used.

LIST OF REFERENCE NUMERALS

2 metering head
3 metering chamber
4 short stroke membrane
5 hydraulic chamber
6 long stroke membrane
9 first part of return mechanism
10 second part of return mechanism
11 recess
12 third part of return mechanism
13 hydraulic channel
15 head cover
17 drive unit block
19 fluid outlet
20 fluid inlet
21 pressure side one way valve
22 suction side one way valve

The invention claimed is:

1. A device for moving a fluid, having a metering head (2) in which a metering chamber (3) is disposed, and a displacement element which can be moved back and forth between a first and a second position, wherein the displacement element delimits the metering chamber (3), and the volume of the metering chamber (3) in the first position of the displacement element differs from the volume of the metering chamber (3) in the second position, wherein a drive unit is provided for moving the displacement element out of the first position into the second position and a return mechanism is provided for moving the displacement element out of the second position into the first position, characterized in that the return mechanism (9, 10) comprises two parts, wherein each part is either a magnet or an element produced from a ferromagnetic material, wherein the first part (9) is disposed on the metering head (2), the second part (10) is connected to the displacement element, and the two parts (9, 10) are configured in a manner such that a magnetic force acting between the two parts (9, 10) exerts a force on the displacement element in the direction of the first position, and a recess (11) is disposed in a wall of the metering chamber (3), in which the first part of the return mechanism (9) which is disposed on the metering head (2) is positioned, wherein the recess (11) has dimensions which correspond to the size of the first part, so that the first part sits flush in the recess, wherein the recess (11) is further configured in a manner such that the second part of the return mechanism (9) which is disposed on the displacement element is at least partially positioned in the recess, such that the recess serves as a guide for the second part of the return mechanism.

2. The device according to claim 1, characterized in that the two parts (9, 10) of the return mechanism are configured and arranged in a manner such that a repulsive magnetic force acts between them.

3. The device according to claim 1, characterized in that the two parts (9, 10) of the return mechanism are configured and arranged in a manner such that an attractive magnetic force is exerted between them.

4. The device according to claim 1, characterized in that the return mechanism comprises a third part (12) which is a magnet or an element formed from a ferromagnetic material, wherein the third part (12) is connected to the metering head (2) and the three parts (9, 10, 12) of the return mechanism are configured and arranged in a manner such that an attractive magnetic force acts between the third part (12) and the second part (10) of the return mechanism.

5. The device according to claim 1, characterized in that the drive unit is a hydraulic drive unit.

6. The device according to claim 1, characterized in that the displacement element is a membrane.

7. The device according to claim 1, characterized in that the magnet is a permanent magnet.

8. The device according to claim 1, characterized in that the volume of the metering chamber (3) is smaller in the second position than in the first position.

9. The device according to claim 8, characterized in that the metering head (2) comprises a head cover (15) in which the metering chamber (3) is disposed, a fluid outlet (19) via which fluid from the metering chamber (3) can leave the metering head (2), and a drive unit block (17).

10. The device according to claim 9, wherein the first part (9) of the return mechanism is disposed in the head cover (15).

* * * * *